United States Patent [19]

Vossbrinck

[11] Patent Number: 4,708,036

[45] **Date of Patent: * Nov. 24, 1987**

[54] STUD TENSIONING APPARATUS

[75] Inventor: William J. H. Vossbrinck, Campbell, Calif.

[73] Assignee: Haskel, Inc., Burbank, Calif.

[ * ] Notice: The portion of the term of this patent subsequent to Aug. 12, 2003 has been disclaimed.

[21] Appl. No.: 742,995

[22] Filed: Jun. 10, 1985

Related U.S. Application Data

[63] Continuation of Ser. No. 577,819, Feb. 7, 1984, abandoned.

[51] Int. Cl.[4] ..... B25B 29/02

[52] U.S. Cl. ..... 81/57.38; 254/29 A

[58] Field of Search ..... 254/29 A; 81/57.38; 29/452; 220/207; 269/287; 279/71

[56] References Cited

U.S. PATENT DOCUMENTS

| | | | |
|---|---|---|---|
| 1,076,710 | 10/1913 | Schultis | 279/71 |
| 2,795,350 | 12/1953 | Lapin | 220/207 |
| 3,008,362 | 11/1961 | Tucker, Jr. | 81/57.38 |
| 3,077,335 | 2/1963 | Singleton | 254/29 A |
| 3,844,533 | 10/1974 | Markiewicz et al. | 254/29 A |
| 3,995,828 | 12/1976 | Orban | 254/29 A |
| 4,315,446 | 2/1982 | Orban | 254/29 A X |
| 4,433,828 | 2/1984 | Spiegelman et al. | 254/29 A |
| 4,438,901 | 3/1984 | Reneau et al. | 254/29 A |
| 4,569,258 | 2/1986 | Orban | 254/29 A X |

FOREIGN PATENT DOCUMENTS

| | | |
|---|---|---|
| 938420 | 1/1956 | Fed. Rep. of Germany . |
| 2641497 | 9/1976 | Fed. Rep. of Germany . |

*Primary Examiner*—Robert C. Watson

*Attorney, Agent, or Firm*—Pretty, Schroeder, Brueggemann & Clark

[57] ABSTRACT

A hydraulic powered stud tensioner as employed to tension stud-like members in forming flanged joints in pipes or like vessels. A housing containing a plurality of segment shaped jaws having thread portions for engaging the stud threads. An actuating sleeve rotatably supported in the housing and having inner camming surfaces. The camming surfaces are arranged so that rotation of the sleeve to one extreme moves the thread portions radially inward into engagement with the stud threads and to the other extreme moves the thread portions radially outward and free of the stud threads. An improved hydraulic actuator having a piston and an improved fluid seal on one side of the piston. An air chamber formed on the opposite side of the piston for receiving compressed air and applying force to the piston in a reverse direction to facilitate disengagement of the jaws from the stud threads. A linkage between the piston and the jaws that has mating spherical surfaces so that efficient force transmission between the piston and the jaws is achieved notwithstanding misalignment of the piston relative to the jaws.

25 Claims, 10 Drawing Figures

STUD TENSIONING APPARATUS

This application is a continuation of application Ser. No. 577,819, filed 2-7-84, now abandoned.

BACKGROUND OF THE INVENTION

1. Field of the Invention

This invention relates to apparatus for tensioning a threaded stud or the like such as is used in making up a flanged joint in pressure lines and pressure vessels, or other environment in which control of stress in threaded fasteners is desired.

2. Description of the Prior Art

Flanged joints in various pressure lines and pressure vessels are widely used in industry. Two parts, typically of cylindrical shape, are manufactured with annular flanges at their ends. The flanges are formed with congruent hole patterns. The two members are joined to one another in a pressure tight manner by first introducing a gasket between the two flanges and then by joining the flanges with threaded stud-like members, e.g., studs, bolts or stud-bolts, which extend through the holes and have nuts engaged therewith. The term "stud" is sometimes used herein for convenience to refer to the broader class of stud-like members to which the invention applies. It is important, particularly in large diameter members, that the tension in the studs be sufficient to withstand imposed forces and be uniform so as to avoid deformation of the flanges and the members to which they are fixed.

A device for tensioning studs in the above described environment is disclosed in U.S. Pat. No. 3,015,975. The patented device includes a hollow tubular housing that fits over the stud and the nut and rests on the surface of the flange. There is a puller bar which has at one end an interiorly threaded collar adapted for engagement with the portion of the stud that protrudes beyond the nut. The puller bar collar is engaged with the stud threads by rotating the puller bar, and there is a hydraulically powered mechanism to which the remote end of the puller bar is fastened. When the hydraulic mechanism is actuated, tension is applied to the stud so that the nut can be tightened, the amount of the tension being controlled by controlling the hydraulic pressure applied to the hydraulic actuator. Devices similar to that referred to above are also shown in U.S. Pats., Nos. 2,866,370; 3,158,015; 3,162,071 and 3,285,568. Substantial commerce exists in such devices, and they are widely used, particularly where flanged joints of large diameter are employed. Formation of a flanged joint is a time consuming procedure, however, because the puller bar must be engaged and disengaged with each stud several times, and engagement and disengagement is a time consuming procedure because the puller bar must be rotated numerous revolutions each time it is engaged with or disengaged from the stud threads.

U.S. Pat. No. 3,995,828 discloses bolt tensioning apparatus having a segmented nut and a mechanism for moving the segments between a radially inward position at which they engage the stud and a radially outward position at which they are free of the stud. The apparatus disclosed in the U.S. Pat. No. 3,995,828 eliminates the necessity to rotate the puller bar through numerous revolutions each time the apparatus is engaged with or disengaged from the stud. Although the device disclosed in the U.S. Pat. No. 3,995,828 reduces the time necessary for engagement and disengagement with the stud, the apparatus requires an unduly long stud because a longitudinally or axially moving sleeve is employed in moving the segments radially. Longitudinal movement of the sleeve requires substantial space between the segments and the longitudinal housing that contains the segments. Consequently, the patented device is useful only on unduly long studs which are undesirable as are the special studs provided with concentric grooves that are specifically disclosed in the U.S. Pat. No. 3,995,828.

SUMMARY OF THE INVENTION

The present invention provides a greatly improved apparatus for tensioning a stud-like threaded member to be held in tension by a nut. The apparatus includes a plurality of jaws positioned to be arrayed about the member, each jaw having an inner surface adapted to engage the threads of the member.

The embodiment of the invention that is described in more detail hereinafter also includes a housing having an internal bore sufficiently large to pass over the stud-like member and the nut and rest on a flange or other surface from which the member projects. Supported within the housing bore are the jaws, four in number in the specific embodiment shown. Circumscribing the jaws is the actuating sleeve which is supported within the housing bore for rotation with respect to the central longitudinal axis thereof. The actuating sleeve has cam surfaces which cooperate with the jaws so that in one rotative position of the actuating sleeve the jaws are in their outward or disengaged position, and at another rotative position of the actuating sleeve the jaws are moved inward into engagement with the stud threads. That the sleeve is actuated by rotation, rather than axial movement, permits the jaws to be positioned so that engagement with the stud-like member is accomplished without requiring an extraordinarily long stud.

Although studs employed in forming a flanged joint typically extend perpendicularly of the flange surfaces, deformation away from the perpendicular relation usually occurs to some minor degree. Tensioning apparatus formed in accordance with one important aspect of the present invention accommodates this deformation or misalignment by providing an engaging surface between the jaws and the puller bar that is concave. Accordingly, even though misalignment occurs, apparatus of the invention can tension the bolt without deforming either the bolt or the apparatus.

The jaws are supported within the housing so that each can experience a moderate degree of independent axial movement. This facilitates engagement with the stud threads without requiring attention to the rotational position of the tensioning device when it is first installed on a stud and assures complete engagement between the jaws and the stud threads.

The foregoing, together with other objects, features and advantages, will be more apparent after referring to the following specification and the accompanying drawings.

DETAILED DESCRIPTION OF A PREFERRED EMBODIMENT

Figure 1:
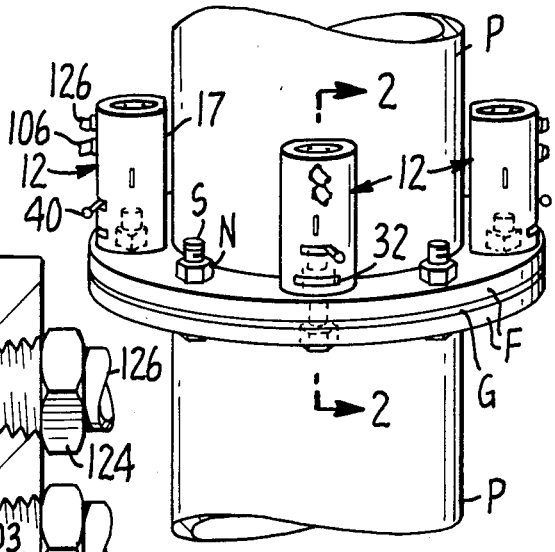
FIG. 1 is a perspective view of a typical flanged joint with which the present invention can be used to advantage.

Referring more particularly to the drawings, reference numeral 12 indicates a housing in which the parts of the apparatus are contained. Housing 12 is typically formed of steel or like high strength material, has a generally cylindrical shape and defines interiorly thereof a bore 14 which has an inside dimension great enough so that the housing can be installed over a nut N engaged with a stud S which extends substantially perpendicularly from the surface of a flange F. Flange F is rigid with a pipe P which is typically of hollow cylindric shape. Between two flanges that are joined by stud S, a gasket G is customarily installed. Housing 12 at its lower end defines an annular abutment surface 16 which is normal to the longitudinal dimension of the housing and of bore 14 and is adapted to bear on flange surface F. The housing has an exterior chordally excised surface portion 17 which permits the device to be used in environments in which there is limited space between the stud and the cylindric part of which the flange is a part.

Bore 14 defines a downward facing shoulder surface 18 against which a nut engaging socket 20 bears. Socket 20 is maintained within bore 14 by means of a retaining ring 22, the surface of the bore being provided with a groove 24 for receiving ring 22 and maintaining the socket in place. Socket 20 defines a hexagonal central opening 26 which is dimensioned to engage nut N so that rotation of the socket imparts corresponding rotation to the nut. The external surface of socket 20 is formed with a plurality of radially extending holes 28. Holes 28 preferably have a circular cross sectional shape; there is a similarly shaped Tommy bar 30 which can be introduced into one of the holes, housing 12 having a circumferentially extending slot 32 through which the Tommy bar can be introduced. The circumferential spacing between adjacent holes 28 is established such that at least one of the holes is always accessible through the slot.

Inward of shoulder 18 is an actuating sleeve indicated generally at 36. Sleeve 36 has an external cylindric surface having a diameter less than that of bore 14 so that the actuating sleeve can rotate within the bore and can skew with respect to the axis of the bore. An elastic O-ring 38 is provided for centering sleeve 36 within the bore while permitting skewing movement of the sleeve, bore 14 being provided with a groove 39 for retaining the O-ring in place. Secured to the external surface of actuating sleeve 36 and extending substantially radially thereof is an operating handle 40. Housing 12 has a circumferentially extending slot 42 through which operating handle 40 extends so that actuator sleeve 36 can be rotated from the exterior of the device.

Actuator sleeve 36 defines a central axial opening indicated generally at 44; disposed within the opening is a plurality of stud engaging jaws, there being four such jaws in the embodiment shown in the drawings, indicated respectively at 46, 48, 50 and 52. Because the jaws are virtually identical, a description of one will suffice as a description of all.

Figure 4:
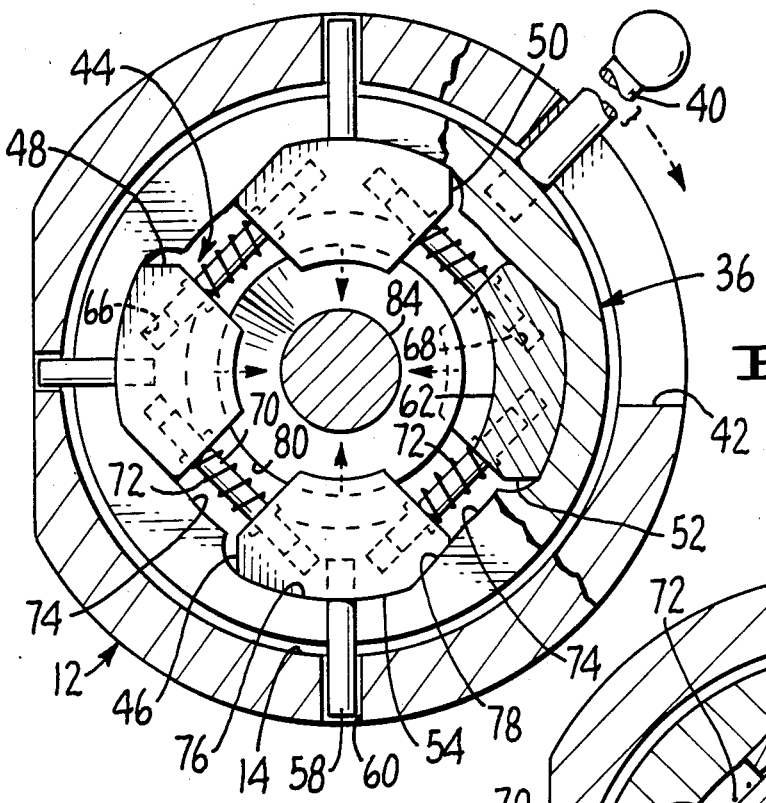
FIG. 4 is a cross sectional view taken on line 4—4 of FIG. 2 and showing the jaws in a disengaged position.
Figure 5:
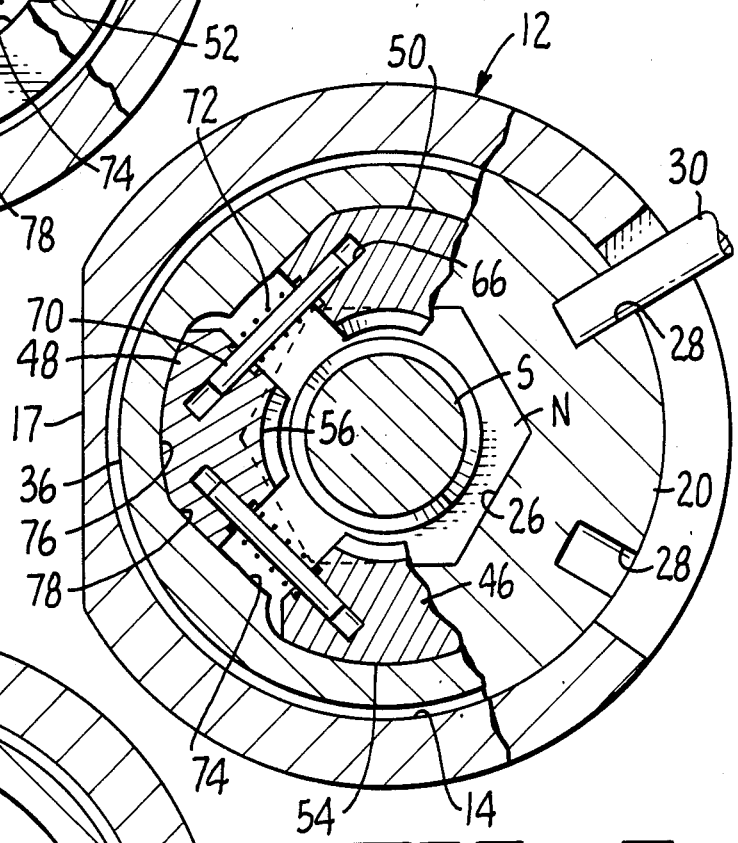
FIG. 5 is a view taken along line 5—5 of FIG. 2 also showing the jaws in a disengaged position.
Figure 6:
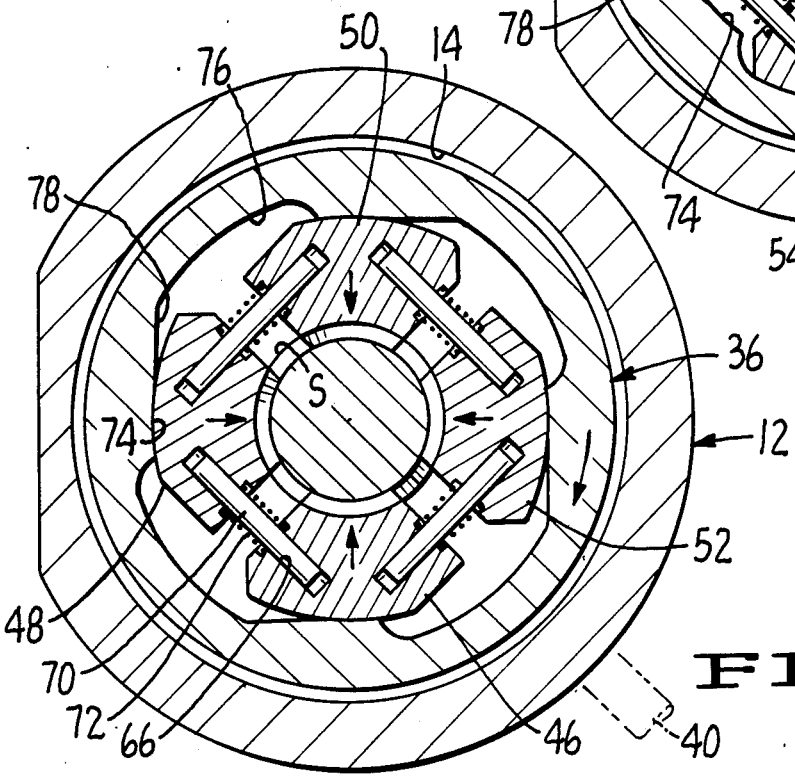
FIG. 6 is a view similar to FIG. 5 showing the jaws in an engaged position.

Each jaw is generally sector shaped in cross section (see FIGS. 4–6) and has an outer arcuate surface 54. At the lower end of the inner surface each jaw has a thread portion 56. The thread segments on thread portion 56 have the same pitch as the threads on stud S and are sufficient in number that, when the jaws are moved inward into engagement with the threads on stud S, sufficient force can be transmitted to the stud to achieve the requisite tension thereon. The jaws are supported within housing 12 such that the lower axial extremity of the jaws is substantially coextensive with the upper surface of socket 20 in order that a substantial portion of the threads of stud S can be engaged. A pin 58 protrudes from the upper extremity of the exterior surface of each of the jaws, the wall of housing 12 being slotted as at 60 to admit the pin therethrough. Slot 60 is axially elongated so as to afford axial movement of the jaws and circumferentially limited to prevent rotation of the jaws when actuator sleeve 36 is rotated. The central region of the inner surface of each of the jaws is excised at 62 thereby to define a cavity that is bounded by all four jaws. The upper extremity of excision 62 is defined by an inward extending abutment surface 64. Surface 64 is of convex spherical shape.

Jaws 46–52 have on their side surfaces upper and lower tangentially extending holes 66 and 68. The holes in adjacent jaw surfaces form confronting hole pairs. Fitted into opposing hole pairs are tangentially extending guide pins 70, the fit between the pins and the holes being sufficiently loose that relative movement between adjacent jaws can occur. Circumscribing each pin 70 is a compression spring 72 which biases the jaws away from one another and outward of engagement with stud S.

Central opening 44 in actuator sleeve 36 is configured so that rotation of the actuator sleeve to one extremity of its travel urges the jaws into engagement with stud S and rotation of the actuator sleeve to its opposite extremity permits springs 72 to urge the jaws radially outward and away from engagement with the stud. Opening 44 in the actuator sleeve has a number of camming surface portions equal to the number of jaws, four in the embodiment shown in the drawing. Camming portions are disposed around the surface of opening 44 in correspondence with the spacing of the jaws. Each camming surface portion includes a first inward extending surface portion 74 which is dimensioned with respect to the jaws so that when the inward extending portion contacts the jaw, the jaw is positioned into engagement with the threads on stud S. Circumferentially spaced from inward extending portion 74, each camming surface portion has a second surface 76 that is disposed radially outward of inward extending portion 74. Portion 76 is so dimensioned that when the outer surface of a jaw rests against it, the jaw is disengaged from the stud. Intermediate inward extending portion 74 and outward disposed portion 76 is a transition portion 78, which effects a smooth transition between the two extreme portions of the camming surface and facilitates movement of actuator sleeve 36 between its two rotational extremes.

Figure 7:
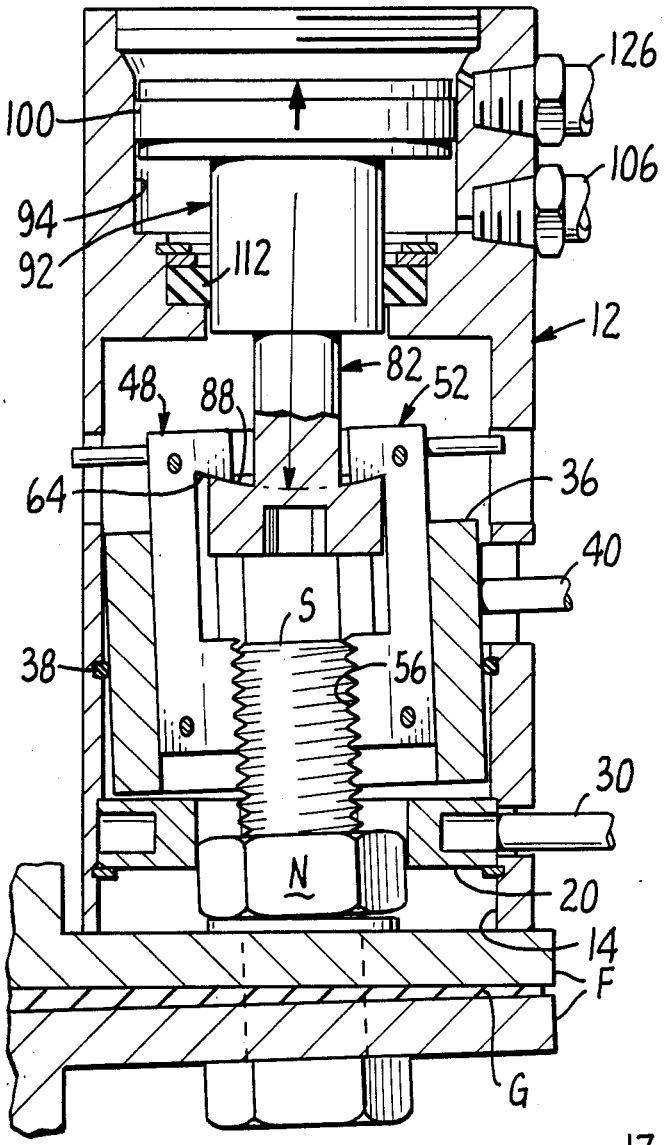
FIG. 7 is a view similar to FIG. 2 showing, in exaggerated form, engagement with a stud that is not perpendicular to the flange through which it extends.

Disposed within the cavity defined by excisions 62 in jaws 46–52 is a head 80 of a puller bar 82. The puller bar includes an axially extending shaft 84 rigid with head 80. At the upper end of shaft 84 is a threaded portion 86. The outside diameter of head 80 is less than the inside diameter of the cavity formed within the jaws, when the jaws are in their inward position. Similarly the outside diameter of shaft 84 is less than the innermost position of jaw abutment 64. Accordingly a degree of skewing between the jaws and puller bar 82 can be tolerated as shown in FIG. 7. In order to assure substantial contact between head 80 and abutment 64 the upper surface 88 of the head is of concave spherical shape having a radius of curvature equal to the radius of curvature of convex abutment surfaces 64 on the jaws.

The lower surface puller bar 82 defines a hexagonal opening 90 which can be engaged with an Allen wrench to impart rotational force to the puller bar during assembly or disassembly of the device. An alternative to hexagonal opening 90 is a screwdriver slot milled in the lower surface of piston 82. The upper threaded portion 86 of the puller bar is received into a complementally threaded opening in a drive piston 92.

Drive piston 92 is supported in a piston chamber 94 in housing 12. The piston chamber is axially aligned with bore 14. At the upper end piston 92 is formed with an enlarged portion 96; the upper surface of the enlarged portion has spanner holes 97 for applying torque to the piston during assembly and disassembly of the device. The side wall of enlarged portion 96 has a slot 98 in which a sealing ring 100 is disposed. Sealing ring 100 cooperates with the wall of piston chamber 94 to afford movement of the piston within the chamber and to form a seal against leakage of hydraulic fluid therepast. Enlarged portion 96 has a lower annular surface 102 against which hydraulic pressure is applied to move the piston upward and to effect engagement between concave spherical surface 88 and the convex spherical surfaces 64 on the jaw abutments. For supplying hydraulic fluid to the lower part of piston chamber 94, there is a port 103 formed in the wall of housing 12. For communicating hydraulic fluid to the port, there are an inlet fitting 104 and a hydraulic fluid line 106. The hydraulic fluid line is connected to a conventional source of pressurized hydraulic fluid which is not shown. For preventing leakage of the hydraulic fluid downward of the cylinder, housing 12 is provided with an inward extending projection 108 in the wall of which an annular cutout 110 is formed. A hydraulic seal 112 is disposed in the cutout, the seal having an inner surface portion contacting piston 92 to permit the piston to move and to prevent leakage of hydraulic fluid therepast. Seal 112 is retained in place by a washer 114 and a snap ring 116 which is engaged in a groove provided in the side wall of projection 108 above the seal.

The upper end of piston chamber 94 is closed by an impervious end closure disk 118. Disk 118 is fastened to housing 12 via a threaded connection 120. Spanner holes 121 are provided in the upper surface of disk 118 to facilitate its installation and removal. To the upper portion of piston chamber 94, i.e. the portion between the top of the piston and the lower surface of disk 118, there is an inlet port 122 with which a fitting 124 is engaged to connect to the port a compressed air line 126. Enclosure 118 is preferably formed of aluminum or like material that is softer than the material of which housing 12 is formed. Such is the case because in the occasional situation where a stud fractures while it is under tension by the device, the likelihood of destruction of the device and injury to users are reduced because upward movement of piston 92 is slowed by deformation and expulsion of end closure disk 118.

Figure 2:
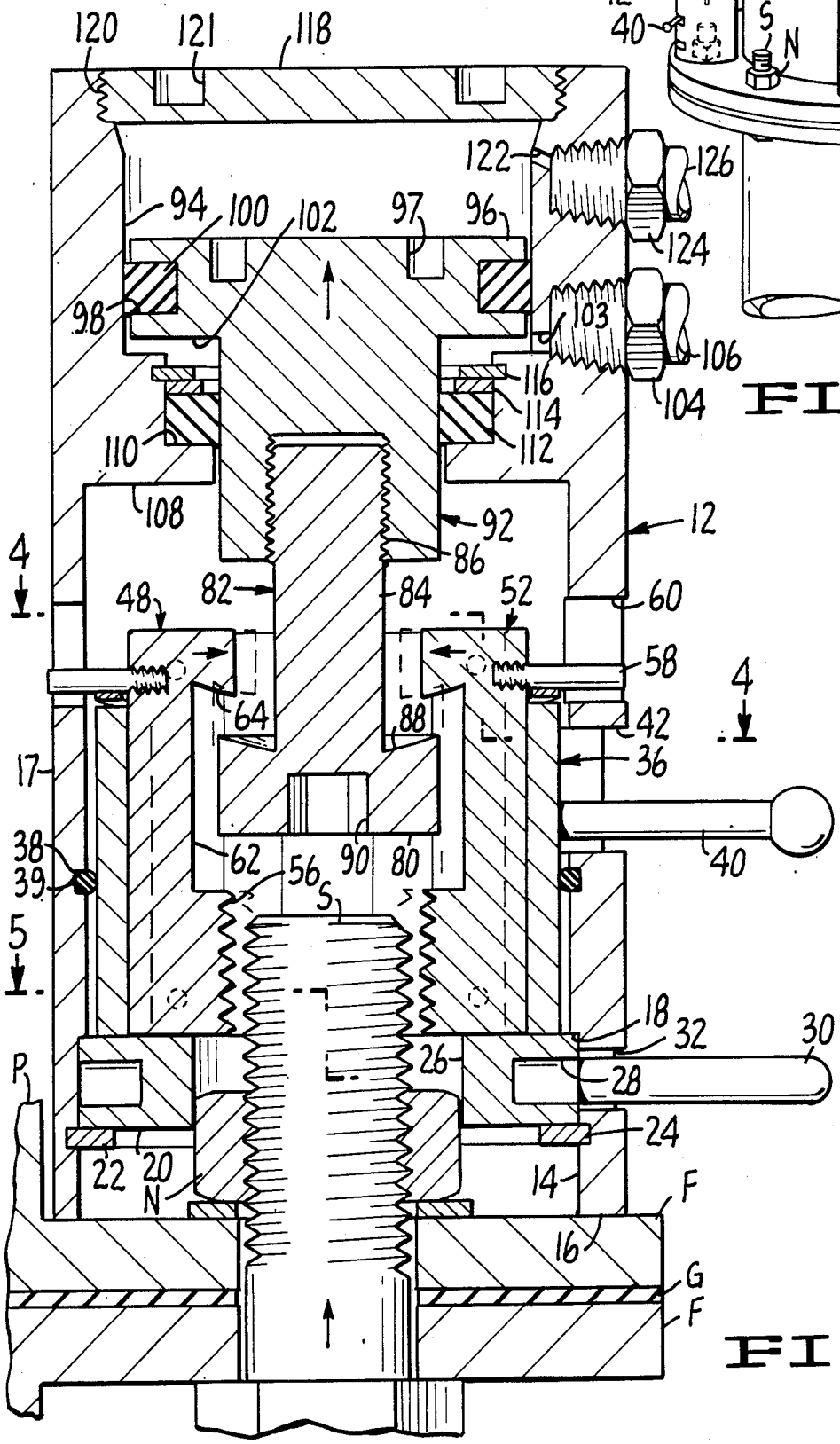
FIG. 2 is an elevation view in cross section of stud tensioning apparatus embodying the invention and taken along line 2—2 of FIG. 1.
Figure 3:
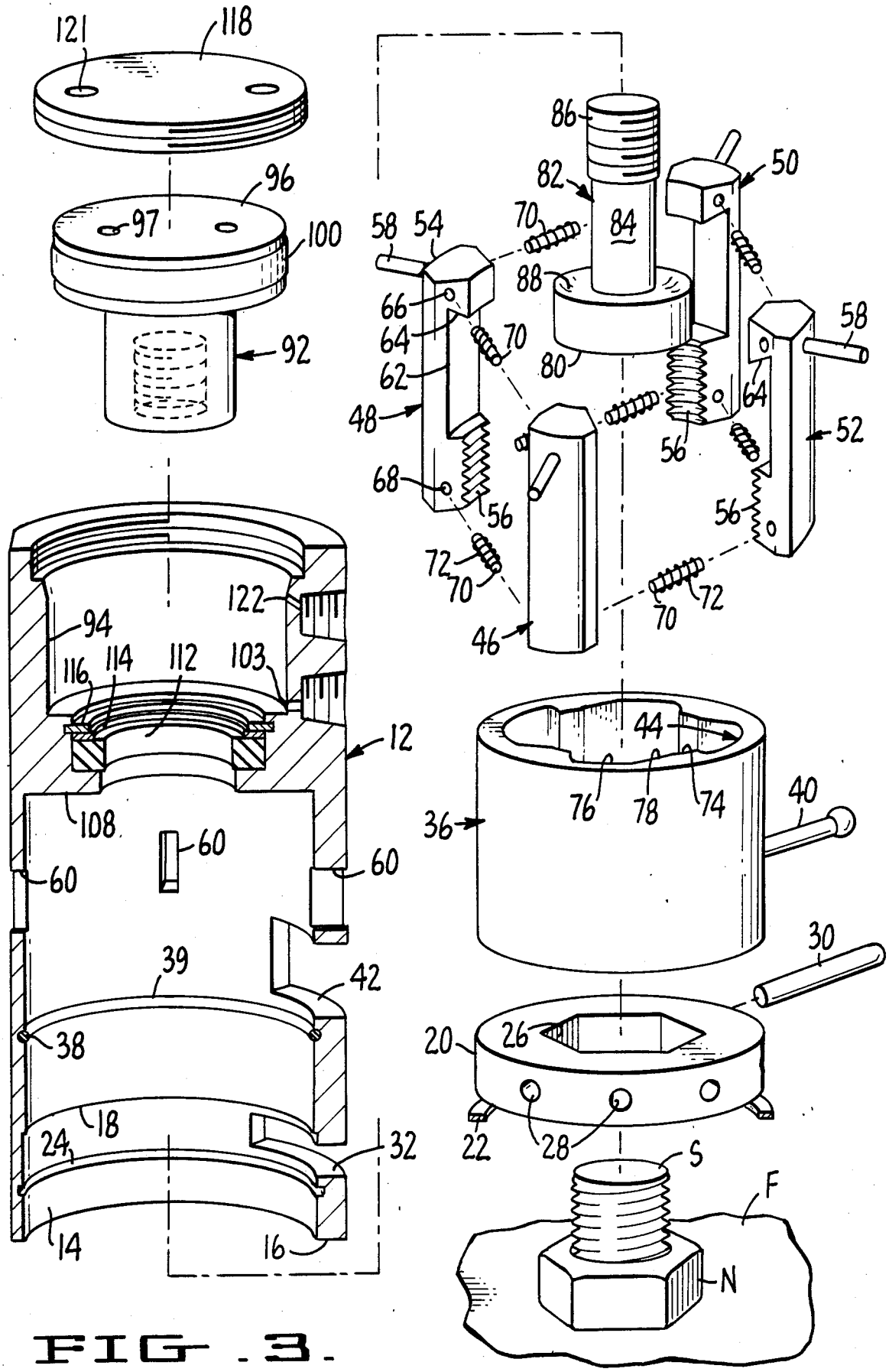
FIG. 3 is an exploded view of the device of FIG. 2 showing the components thereof.

In operating a stud tensioner according to the invention, the flanged joint is first made up by installing a gasket G, aligning the flange holes with one another, and introducing studs S through aligned pairs of flange holes. Nuts N are threaded onto the studs until the nut surfaces are moved into contact with the flange surface. Next one or more stud tensioners are placed onto the protruding nut and stud as depicted in FIG. 2. It will be noted that actuator sleeve 36 is in a position so that thread portions 56 of the jaws are retracted from the threads of stud S. Additionally, nut N resides in the central hexagonal opening of socket 20. As shown in FIG. 1, it is typical practice to employ plural stud tensioners at a given time, typically spaced uniformly around a flange.

Next, actuator sleeve 36 is rotated by applying circumferential force on operating handle 40. See FIG. 4. Such movement of operating handle 40 causes camming transition portion 78 to traverse the outer surfaces of the jaws and eventually moves inner camming surface 74 into contact with the outer surfaces of the jaws. This moves thread portions 56 into threaded engagement with the threads of stud S. See FIG. 6. Because the jaws are axially slidable within both actuator sleeve 36 and housing 12, the jaws can quickly and completely move into threaded engagement with stud S.

Next, hydraulic pressure is applied to line 106 of each stud tensioning apparatus. The equipment for providing the pressure and adjusting its magnitude is not shown, because such equipment is well known and its operation is well understood. Suffice it to say, typical practice requires that a pressure less than the pressure to effect the final stud tensioning be first applied to all studs with the specific pressure increasing in increments until the final pressure and final stud tension is achieved. Upon entry of pressurized hydraulic fluid through line 106 and fitting 104 and through port 103, upward force is applied to piston 92 and corresponding force is applied to puller bar 82 until concave spherical surface 88 of the puller bar contacts the convex spherical abutment surfaces 64 on jaws 46–52. Corresponding force is thus applied on stud S to tension it. With the stud in the tensioned condition, Tommy bar 30 is employed to rotate socket 20 and nut N until the lower surface of the nut firmly contacts the surface of flange F.

When each nut with which a stud tensioning apparatus of the invention is engaged has been tightened, hydraulic pressure on line 106 is discontinued. Actuator sleeve 36 is then rotated to a position at which camming surface portions 76 are in rotational alignment with the outer surfaces of jaws 46–52. Finally air pressure is applied via line 126 which applies downward force on piston 92 and puller bar 82. Such force moves puller bar surface 88 out of contact with jaw abutment surfaces 64 so that the force of springs 70 can separate the jaws from one another and retract jaw thread portions 56 from stud S. Removal of the apparatus from a protruding stud is then possible.

In many environments in which flanged joints are employed, the flanges distort somewhat as nuts N are tightened onto stud S against the surface of the flange.

Such distortion is particularly severe when relatively soft gaskets G are employed. In FIG. 7, wherein the distortion is exaggerated for clarity, it will be seen that stud S extends from the surface of flange F at an angle other than 90 degrees. Because lower surface 16 of housing 12 is forced against the surface of the flange, stud S is not precisely aligned with the central axis of passage 14. The gap between the outer surface of actuator sleeve 36 and the inner surface of passage 14 permits the sleeve as well as jaws 46–52 within the sleeve to move to a position askew of the central axis of passage 14 and into secure, intimate engagement with the threads on stud S. Moreover, because the upper surface 88 of puller bar 82 is concavely spherical and because the abutment surfaces 64 on the jaws are congruently convexly spherical, secure engagement between the puller bar, which remains axially aligned with the axis of passage 14, and the jaws, which skew with respect to the axis of passage 14, is achieved. O-ring 38 serves to retain the actuator sleeve and the jaws centrally of passage 14, but because of the elasticity in the O-ring, the jaws can move to a skewed position.

Figure 8:
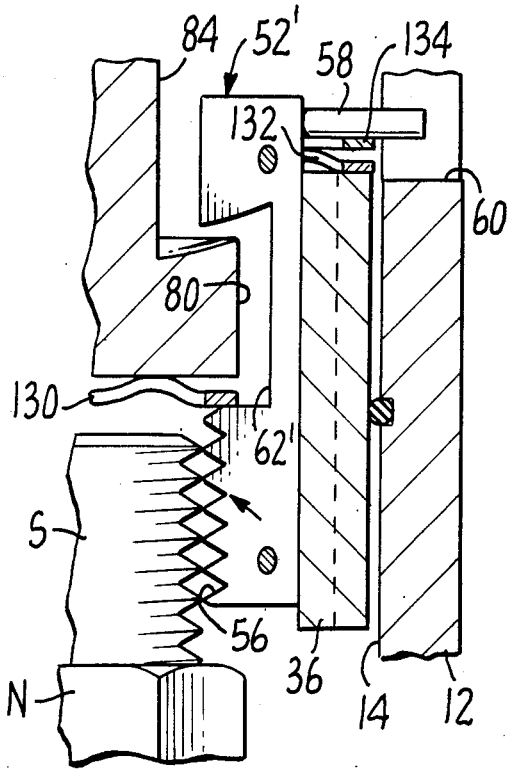
FIG. 8 is a fragmentary view at enlarged scale showing orientation between a modified jaw and the stud prior to engagement therebetween.

A modification of a stud tensioner according to the invention is shown in FIG. 8. In certain installations it is desirable to minimize the height of the stud tensioner as much as possible, and in the modification seen in FIG. 8 there is seen a jaw 52' having an excision 62' which has a vertical dimension substantially less than that of excisions 62 to which reference has been previously made. The vertical dimension of excision 62' is sufficiently greater than that of puller bar head 80 that skewing as described previously in connection with FIG. 7 can occur. In addition, there is sufficient additional space for a wave washer 130 between the lower surface of puller bar head 80 and the upward facing surfaces of the respective excisions 62'. Wave washer 130 is formed of spring steel or like resilient material and has upward extending undulations that bear against the lower surface of the puller bar and downward extending undulations that bear on the upward facing surfaces of the excisions 62'.

Exterior of the jaws, such as jaw 52', there is a wave washer 132 larger than wave washer 130 but otherwise of generally similar construction. Between wave washer 132 and pins 58 there is a flat washer 134 which affords a bearing surface for the upper undulations of wave washer 132. The lower undulations of the wave washer bear against the upper surface of actuator sleeve 36. Thus it will be seen that the jaw 52' and its counterparts not shown in FIG. 8 are resiliently supported by wave washers 130 and 132. This assures that irrespective of the initial relative position of thread portion 56 and the threads on stud S, intimate threaded engagement between the jaw and the stud is achieved upon operation of actuator sleeve 36. If the extremities of thread portion 56 reside on the upper surface of the threads on stud S, jaw 52' will move upward as actuator sleeve 36 is rotated. If the extremities of thread portion 56 reside on the lower surfaces of the thread studs, jaw 52' will move downward in response to rotation of actuator sleeve 36. The coaction of wave washers 130 and 132 permit both directions of movement. Because the operation of the embodiment of FIG. 8 is otherwise identical to that previously described, no further explanation of the device is given.

Figure 9:
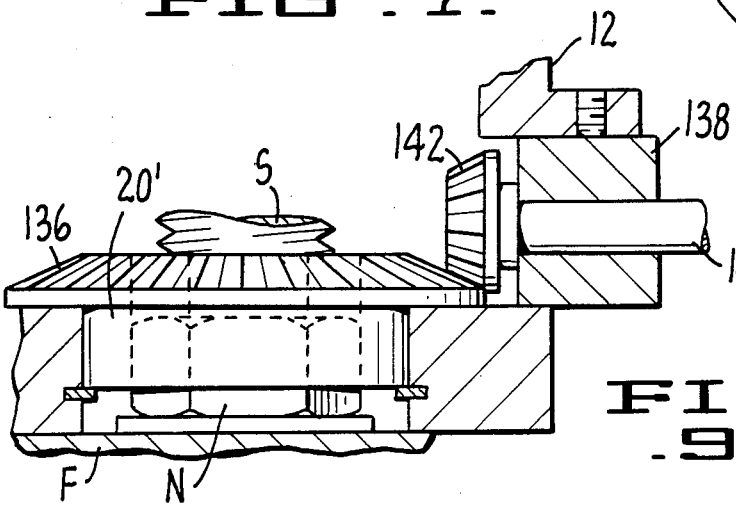
FIG. 9 is a fragmentary view showing an alternate form of driving mechanism for the nut socket.

The invention is not limited to stud tensioners in which socket 20 is rotated by Tommy bar 30. In FIG. 9 is shown a socket 20' which has fixed to its upper extremity a bevel gear 136. Supported within housing 12 is a bearing 138 which supports a drive shaft 140 for rotation about an axis that extends radially of the central axis of housing 12. Fastened to the inner end of drive shaft 140 is a bevel gear 142 which meshes with bevel gear 136 so that upon rotation of drive shaft 140 by a suitable handle, not shown, rotation is imparted to socket 20' and nut N engaged thereby.

Figure 10:
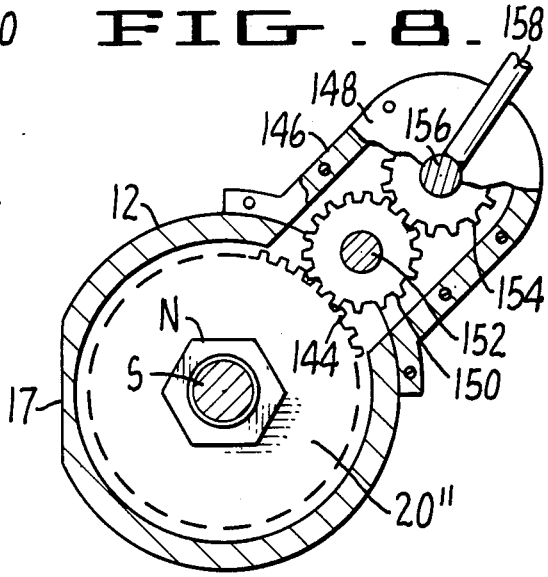
FIG. 10 is a fragmentary view of still another form of driving mechanism for the nut socket.

Still another mechanism for imparting rotation to nut N is shown in FIG. 10. There is a socket 20'' which has on its periphery gear teeth 144. Mounted on the exterior surface of housing 12 and extending radially outward therefrom is a gear housing 146 which has a cover plate 148 that is broken away in FIG. 10 to reveal internal details. There is an idler pinion 150 that has teeth which mesh with teeth 144 on socket 20''. Pinion 150 is supported for free rotation on a shaft 152.

Radially outward of idler pinion 150 within gear housing 146 is a drive gear 154 which is supported for rotation on a vertically extending shaft 156. Drive gear 154 has teeth that mesh with idler gear 150 so that rotation of the drive gear effects rotation of socket 20''. Shaft 156 extends above the cover plate 148 and has radial portion 158 which enables the user to apply torque to shaft 166 and to drive gear 154. Thus nut N can be tightened by the consequent torque applied to socket 20''.

Thus it will be seen that the invention provides a stud tensioning apparatus which affords numerous salutary advantages. The invention can be embodied in a device that consists of a small number of rugged parts. The configuration of actuator sleeve 36 and its actuation in a rotational direction together with limited independent axial movability of the jaws permits construction of a quick acting device that can be conveniently engaged with a stud. The gap between the outer surface of actuator sleeve 36 and the surface of passage 14, the presence of O-ring 38, and the spherical surfaces on puller bar head 80 and jaw abutments 64 coact to assure expeditious and accurate tensioning of studs even in the presence of deformation of the flanges. The presence of an air chamber above piston 92 asures quick release of the device from a stud, and formation of end closure disk 118 from relatively soft material protects the device and its users in the rare event that a stud fractures during tensioning thereof.

Although several embodiments of the invention have been shown and described it will be apparent that other adaptations and modifications can be made without departing from the true spirit and scope of the invention.

What is claimed is:

1. An apparatus for tensioning a threaded stud-like member with which a nut is engaged comprising a housing defining a cylindrical bore having a cross sectional dimension greater than the outside diameter of the stud and the nut, said housing having a plurality of elongated slots therein and a longitudinal extremity that defines a substantially annular surface transverse to said bore and adapted for engagement with a surface from which said stud-like member protrudes, a plurality of generally sector-shaped jaws having inner surfaces that define thread portions configured for engagement with the threads on the stud, each of said jaws being aligned with one of said elongated slots, a pin fixed to each said jaw and extending radially outward thereof through one of said slots, each said pin and slot serving to inhibit rotative movement of said jaw and to afford longitudinal movement thereof, means for supporting said jaws in said housing so that said inner surfaces are spaced substantially uniformly about said stud and define a substantially cylindrical opening for receiving said stud therethrough, said supporting means including an actuating sleeve defining an opening and circumscribing said jaws, said actuating sleeve having a cylindrical external surface that has a diameter less than the inside diameter of said bore so that said sleeve is rotatable relative to said housing, said sleeve having an inner surface that defines a plurality of cam surfaces equal in number to said jaws, each of said jaws having a portion extending beyond the longitudinal extremity of said actuating sleeve in a direction remote from said annular surface and a surface portion disposed radially outwardly of said threaded portion and adapted for cooperation with one of said cam surfaces, each said cam surface having a first inward extending region dimensioned to position a jaw contacted thereby in threaded engagement with the threads of said stud-like member, each said cam surface also having a second region circumferentially spaced from said first region and disposed radially outward thereof so that when said second region contacts a jaw said jaw is positioned radially outward of the stud threads, each said cam surface also having a transition region intermediate said first and second regions to effect radial movement of said jaws between an engaged position and an outward position in response to rotation of said actuating sleeve within said housing, means for selectively rotating said actuating sleeve, means for applying axial force to said jaws so as to apply tension to said stud-like member, means for preventing said jaws from rotating with said sleeve, and nut driving means for imparting rotation to said nut.

2. Apparatus according to claim 1 including means for resiliently biasing said jaws to an axial position at which said pins are disposed intermediate the longitudinal extremities of respective said slots.

3. Apparatus according to claim 1 wherein said jaw portions have inward facing excisions that define upper and lower radially disposed abutment surfaces and wherein said axial force applying means includes a head disposed within said excisions, said head and said excisions being dimensioned to form an upper clearance space between said head and said upper abutment surface and a lower clearance space between said head and said lower abutment surface, said resilient biasing means including an upper wave washer disposed in said upper clearance space and a lower wave washer disposed in said lower clearance space.

4. An apparatus for tensioning a threaded stud-like member with which a nut is engaged comprising a housing defining a cylindrical bore having a cross sectional dimension greater than the outside diameter of the stud and the nut, said housing having a longitudinal extremity that defines a substantially annular surface transverse to said bore and adapted for engagement with a surface from which said stud-like member protrudes, a plurality of generally sector-shaped jaws having inner surfaces that define thread portions configured for engagement with the threads on the stud and having axial extensions extending from said threaded portions, said axial extensions defining remote from said thread portions reentrant convex abutments, said abutments lying in a substantially spherical surface, means for supporting said jaws in said housing so that said inner surfaces are spaced substantially uniformly about said stud and define a substantially cylindrical opening for receiving said stud therethrough, said supporting means including an actuating sleeve defining an opening and circumscribing said jaws, said actuating sleeve having a cylindrical external surface that has a diameter less than the inside diameter of said bore so that said sleeve is rotatable relative to said housing, said sleeve having an inner surface that defines a plurality of cam surfaces equal in number to said jaws, each said jaw having a surface portion disposed radially outwardly of said threaded portion and adapted for cooperation with one of said cam surfaces, each said cam surface having a first inwardly extending region dimensioned to position a jaw contacted thereby in threaded engagement with the threads of said stud-like member, each said cam surface also having a second region circumferentially spaced from said first region and disposed radially outwardly thereof so that when said second region contacts a jaw said jaw is positioned radially outwardly of the stud threads, each said cam surface also having a transition region intermediate said first and second regions to effect radial movement of said jaws between an engaged position and an outward position in response to rotation of said actuating sleeve within said housing, means for selectively rotating said actuating sleeve, means for applying axial force to said jaws so as to apply tension to said stud-like member, means for preventing said jaws from rotating with said sleeve, and nut driving means for imparting rotation to a nut threaded on the tensioned stud, said axial force applying means including a rigid puller bar defining a shoulder, said shoulder defining a concave spherical surface portion having a radius of curvature equivalent to said reentrant abutments so as to afford surface to surface contact between said shoulder and said reentrant abutments irrespective of the alignment between said puller bar and said jaws, and means for controllably displacing said puller bar in an axial direction away annular surface.

5. Apparatus according to claim 4 wherein said actuating sleeve has an outer diameter less than the inner diameter of said housing bore so that said actuating sleeve can skew within said bore and an elastic O-ring disposed between said bore and said outer cylindrical surface for supporting said sleeve centrally of said bore and being resiliently yieldable to permit said actuating sleeve and said jaws to skew within said bore.

6. An apparatus for tensioning a threaded stud-like member that projects from a flange surface and with which a nut is engaged comprising a rigid housing defining a central passage having a cross sectional dimension greater than the outside diameter of the stud-like member and the nut, said housing having a longitudinal extremity that defines a substantially continuous planar surface transversely circumscribing said passage and adapted for engagement with said flange surface, a plurality of generally sector-shaped jaws having inner surfaces adapted for engagement with the threads on the stud-like member, means for supporting said jaws in said housing passage so that said inner surfaces are spaced substantially uniformly about said stud-like member and define an opening for receiving said member therethrough, said supporting means including an actuating sleeve defining an opening and circumscribing said jaws, said actuating sleeve having a cylindrical external surface, a portion of said passage inward of said continuous planar surface forming a cylindrical bore complementary to said cylindrical external surface so that said sleeve is rotatable relative to said housing between a first position and a second position circumferentially spaced from said first position, said sleeve having an inner surface that defines means for positioning said jaws in engagement with the stud threads in said first position and radially outward of the stud threads in said second position, means for selectively rotating said actuating sleeve position, means for applying axial force to said jaws in said first position, nut driving means for imparting rotation to a nut threaded on the tensioned stud, and rotation preventing means including circumferentially spaced apart portions of said rigid housing aligned with respective ones of said jaws and defining circumferentially limited, axially elongate slots, and a pin fixed to each said jaw and projecting radially outward thereof into a respective one of said slots.

7. An apparatus for tensioning a stud-like member, said apparatus comprising:

a plurality of radially movable jaws positioned to be arranged about said stud-like member, each of said jaws having an engagement surface with deformations thereon whereby said jaws can positively engage said stud-like member to apply axial tension thereto;

pull means to be centrally positioned in approximate axial alignment with said stud-like member for applying a tensioning force to said jaws that is approximately axially aligned with said stud-like members and for permitting skewing movement of said jaws relative to the direction of said tensioning force to allow for any misalignment between said pulling means and said stud-like member, said jaws projecting from said pull means along said stud-like member; and a rotatable actuating sleeve defining an axial opening within which said jaws are disposed, said sleeve defining interior cam surfaces contoured so as to force said jaws to move radially inwardly into engagement with said stud-like member when said sleeve occupies a first rotational position and to permit said jaws to move radially outwardly out of engagement with said member when said sleeve occupies a second rotational position.

8. The apparatus of claim 7 wherein said sleeve has a fixed axial position relative to said jaws independent of its rotational position.

9. The apparatus of claim 7 wherein said engagement surfaces are grooved to receive threads on said stud-like member.

10. The apparatus of claim 7 wherein each of said cam surfaces has a first region extending inwardly and dimensioned to position one of said jaws contacted thereby in engagement with said stud-like member and a second region circumferentially spaced from said first region and disposed radially outwardly thereof to permit said jaws to be positioned radially outwardly from said stud-like member and out of engagement therewith.

11. The apparatus of claim 10 wherein each of said cam surfaces further includes a transition region intermediate said first and second regions to effect radial movement of said jaws.

12. The apparatus of claim 7 further comprising nut driving mean for imparting rotation to a nut in threaded engagement with said stud-like member.

13. The apparatus according to claim 7 further comprising:

a housing in which said sleeve is disposed; and means for selectively rotating said sleeve within said housing between said first and second positions.

14. The apparatus of claim 13 wherein said housing is connected to said jaws to prevent rotation of said jaws with said sleeve.

15. The apparatus of claim 13 wherein said housing has an abutment surface for engagement with a surface from which said stud-like member projects to apply a reaction force as tension is applied to said stud-like member.

16. The apparatus of claim 13 wherein said housing defines a piston chamber and said pull means further comprises a piston reciprocable within said chamber to generate said tensioning force.

17. Apparatus according to claim 7 further comprising means for resiliently biasing said jaws away from said stud-like member and toward a position in which they do not engage said member.

18. An apparatus for tensioning a threaded stud-like member comprising:

a housing;

a plurality of radially movable jaws disposed with said housing and positioned to be arrayed about said stud-like member, each of said jaws having a grooved engagement surface adapted to receive the threads of said member, whereby said jaws can positively grip said stud-like member to apply axial tension to it;

hydraulic pull means attached to said housing and centrally positioned with respect to said jaws so to be in approximate axial alignment with said stud-like member for applying a tensioning force to said jaws that is approximately axially aligned with said stud-like members and for permitting skewing movement of said jaws relative to the direction of said tension force to allow for any misalignment between said pulling means and said stud-like member, said jaws projecting from said pull means along said stud-like member; and a rotatable actuating sleeve defining an axial opening within which said jaws are disposed, said sleeve having interior cam surfaces surrounding said jaws each having a first region for causing a corresponding jaw to be positioned inwardly against said stud-like member and a second region disposed radially outwardly with respect to said first region for permitting said corresponding jaw to be positioned outwardly out of engagement with said stud-like member, whereby said cam surfaces cause said jaws to move radially inwardly into engagement with said stud-like member when said sleeve occupies a first rotational position and permit said jaws to move radially outwardly out of engagement with said stud-like member when said sleeve occupies a second rational position.

19. The apparatus of claim 18 wherein each of said cam surfaces includes a third region forming a transition between said first and second regions.

20. The apparatus of claim 18 wherein said sleeve has a fixed axial position relative to said jaws independent of its rotational position.

21. The apparatus of claim 18 further comprising nut driving mean for imparting rotation to a nut in threaded engagement with said stud-like member.

22. The apparatus of claim 18 wherein said housing defines a piston chamber and said pull means further comprises a piston reciprocable within said chamber to generate said tensioning force.

23. The apparatus of claim 18 further comprising resilient means for urging said sleeve toward a centered position while permitting skewing movement of said sleeve.

24. The apparatus of claim 23 wherein said resilient means comprises an O-ring.

25. The apparatus of claim 18 further comprising means for preventing rotation of said jaws relative to said housing.

* * * * *